US010576513B2

(12) United States Patent
Baumgartner

(10) Patent No.: US 10,576,513 B2
(45) Date of Patent: Mar. 3, 2020

(54) DEVICE FOR RINSING A CONTAINER WITH A RINSING MEDIUM

(71) Applicant: KRONES AG, Neutraubling (DE)

(72) Inventor: Sebastian Baumgartner, Prackenbach (DE)

(73) Assignee: KRONES AG, Neutraubling (DE)

( * ) Notice: Subject to any disclaimer, the term of this patent is extended or adjusted under 35 U.S.C. 154(b) by 44 days.

(21) Appl. No.: 15/065,633

(22) Filed: Mar. 9, 2016

(65) Prior Publication Data

US 2016/0263635 A1 Sep. 15, 2016

(30) Foreign Application Priority Data

Mar. 10, 2015 (DE) ..... 20 2015 101 220 U

(51) Int. Cl.

| | |
|---|---|
| ***B08B 15/00*** | (2006.01) |
| ***B08B 9/34*** | (2006.01) |
| ***B08B 5/02*** | (2006.01) |
| ***B08B 5/04*** | (2006.01) |
| ***B08B 7/04*** | (2006.01) |
| ***B08B 9/093*** | (2006.01) |
| ***B08B 9/20*** | (2006.01) |
| ***B08B 9/28*** | (2006.01) |

(52) U.S. Cl.

CPC ..... *B08B 15/00* (2013.01); *B08B 5/02* (2013.01); *B08B 5/04* (2013.01); *B08B 7/04* (2013.01); *B08B 9/093* (2013.01); *B08B 9/20* (2013.01); *B08B 9/28* (2013.01); *B08B 9/34* (2013.01)

(58) Field of Classification Search

None

See application file for complete search history.

(56) References Cited

U.S. PATENT DOCUMENTS

| | | | | |
|---|---|---|---|---|
| 2,240,069 A | 4/1941 | Fechheimer et al. | | |
| 2,644,188 A * | 7/1953 | Pacilio | B08B 9/28 | 15/304 |
| 2002/0014542 A1 * | 2/2002 | Creasey | B65G 69/188 | 239/263.3 |

FOREIGN PATENT DOCUMENTS

| | | | |
|---|---|---|---|
| DE | 102010043014 | 5/2011 | |
| DE | 102010043014 A1 * | 5/2011 | B08B 9/32 |
| DE | 102011075237 | 11/2012 | |
| EP | 2045071 | 4/2009 | |

(Continued)

OTHER PUBLICATIONS

Office Action issued in related Chinese Patent Application No. 201610136481.8 dated Sep. 29, 2017.

*Primary Examiner* — Jason Y Ko
*Assistant Examiner* — Cristi J Tate-Sims
(74) *Attorney, Agent, or Firm* — Haynes and Boone, LLP

(57) ABSTRACT

A device for rinsing a container with a rinsing medium is described. The device includes a nozzle for introducing the rinsing medium into the container that is to be rinsed and a suction extractor for extracting by suction at least a portion of the rinsing medium that flows back out of the container. The nozzle has a medium outlet through which the rinsing medium enters the container that is to be rinsed. The nozzle is displaceably guided in a guide and is displaceable between a withdrawn position for positioning the container and a position in which it is inserted in the container for rinsing the container with the rinsing medium. A guide is disposed between the medium outlet of the nozzle and at least a region of the suction extractor.

20 Claims, 3 Drawing Sheets

(56) References Cited

FOREIGN PATENT DOCUMENTS

| | | | | |
|---|---|---|---|---|
| FR | 2779668 | | | 12/1999 |
| GB | 654570 | | | 6/1951 |
| JP | 2002-308 231 | | | 10/2002 |
| JP | 2002308231 | A | * | 10/2002 |

* cited by examiner

DEVICE FOR RINSING A CONTAINER WITH A RINSING MEDIUM

CROSS REFERENCE TO RELATED APPLICATION

This application claims priority from German Patent Application No. DE 20 2015 101 220.9, filed on Mar. 10, 2015 in the German Patent and Trademark Office, the disclosure of which is incorporated herein by reference in its entirety.

BACKGROUND

Technical Field

The present invention relates to a device for rinsing a container with a rinsing medium, for example a device in the form of a rinser, air rinser or ionized air rinser.

State of Art

It is known to rinse containers in beverage filling plants by means of the introduction of a rinsing medium before they are actually filled with a fill product. For this purpose, a so-called rinser is usually provided upstream of a filler by means of which the applicable fill product is introduced into the containers that are to be filled. The containers to be filled, for example bottles, are substantially disposed upside down in the rinser, i.e. with their mouths oriented substantially downwards. The applicable rinsing medium is then introduced into the container, in order to clean the interior of the container and in particular to remove any particles that may still be present in the interior of the container. By means of this rinsing, the interior of the container is prepared to receive the actual fill product, which is introduced into the rinsed container in a downstream filler.

The rinsing medium that is used in this case can be for example water, sterilized water or another rinsing fluid. It is also possible to use air, sterile air, ionized air or another rinsing gas or rinsing gas mixture as a rinsing medium. When the interior of the container is rinsed with fluid, the applicable rinsing medium then flows out of the downwards oriented mouth of the container that is retained in the rinsing device.

When the rinsing is carried out with gaseous media, i.e. for example air, sterile air or ionized air, the rinsing medium similarly flows into the container and out again through its mouth. Rinsing with gaseous media achieves, firstly, a specified atmosphere inside the container, for example with a sterile gas. Secondly, dust, dirt and other particles are picked up in the flow of gas and thereby flushed out of the container. By means of the use of ionized air, it is possible for example to counteract charging of the interior walls of the container, so that electrostatic adhesion of particles in the container can be reduced, and the particles can accordingly be efficiently flushed out.

The applicable rinsing medium is introduced into the container that is to be treated via a nozzle, which has at its upper end a medium outlet, out of which the applicable rinsing medium flows into the interior of the container that is to be rinsed. In this, it is known to dispose the container over the rinsing nozzle such that the rinsing nozzle extends into the mouth area of the container that is to be treated, i.e. into the interior of the container that is to be treated. In order to dispose the container in this manner over the nozzle, it is necessary to lift the container or the nozzle a relatively large distance.

It is further known, for example from DE 10 2010 043 014 A1, to insert the nozzle with its medium outlet into the container when the container has already been positioned above the nozzle.

Due to the moving parts inside the rinsing device, in particular due to the fact that a lift or relative displacement of the nozzle with respect to a guide is provided, abraded matter can be produced, which then undesirably enters the container that is to be rinsed.

SUMMARY

An improved device for rinsing containers is described.

Accordingly, in some embodiments, a device for rinsing a container with a rinsing medium is provided, comprising a nozzle for introducing the rinsing medium into the container that is to be rinsed, wherein the nozzle has a medium outlet through which the rinsing medium enters the container that is to be rinsed, wherein the nozzle is displaceably guided in a guide and is displaceable between a withdrawn position for positioning the container and a position in which it is inserted in the container for rinsing the container with the rinsing medium, and a suction extractor is provided for extracting by suction at least a portion of the rinsing medium that flows back out of the container. According to some embodiments of the present invention, the guide is disposed between the medium outlet of the nozzle and at least a region of the suction extractor.

Due to the fact that the guide is disposed between the medium outlet of the nozzle and at least a region of the suction extractor, possible products of abrasion from the guide are extracted by means of the suction extractor. Accordingly, it can be achieved that these products of abrasion, for example particles that are detached from the material of the guide, or particles that adhere to the nozzle and are scraped off by the guide, are substantially prevented from entering the container that is to be rinsed or the areas surrounding the rinsing device, the rinser or a downstream filler. In this manner, hygienically improved rinsing of the containers can be achieved.

This is particularly important if the nozzle is displaced back and forth in the guide in order to reach the withdrawn position or the position in which it is inserted in the container, since it is particularly during the displacement of the nozzle that particles are dislodged, shed or abraded, or further detaching of particles takes place, for example from the exterior of the nozzle. This detaching or shedding of particles occurs in or at the guide of the nozzle.

These particles can originate from the nozzle and/or the guide, and are produced by the friction and relative movement between the guide and the nozzle. Particles can however also reach and adhere to the nozzle and/or the guide from within the container, and similarly be detached by the movement of the nozzle relative to the guide.

The particles that are set free in this manner at the guide can thus be extracted by suction due to the disposal of the guide between the suction extractor and the medium outlet.

The suction extractor, in several embodiments, surrounds the guide, so that particles which are set free at the upper or lower ends of the guide, where the nozzle enters or leaves the guide, can be immediately extracted by means of the suction extractor.

The guide is, in various embodiments, disposed in its entirety in the area in which extraction by suction takes place, in order that particles that occur in the area of the parts that move relative to each other, i.e. the nozzle that is displaced in the guide, can be extracted by suction, so that the entry of these particles into the container or the surrounding area can be prevented.

The guide is also, in some embodiments, disposed between the medium outlet and the suction extractor, so that particles that are set free by the guide can be extracted by means of the suction extractor.

The suction extractor is, in many embodiments, provided such that at least a portion of the flow of rinsing medium that leaves the container through its mouth during rinsing is also extracted by suction. An appropriate suction aperture is, in several embodiments, provided, by means of which the entirety, or at least a portion, of the flow of the rinsing medium can be extracted by suction. Accordingly, during the rinsing of the container there is a flow of rinsing medium that is directed out of the container, flows at least in part around the guide, and reaches at least in part the suction extractor. By this means, it is possible, by directing the flow of rinsing medium in this manner, to prevent rinsing medium that has already flowed out of the container from flowing back into the container and thereby transporting particles that may have been detached in the area of the guide.

The nozzle, in various embodiments, comprises a nozzle piston for displacing the nozzle with respect to the guide by means of the pressure of the rinsing medium. In this manner, when the appropriate pressure conditions are present, or by switching an appropriate valve, the nozzle can be displaced relative to the guide into the container that is to be rinsed, in order in this manner to reach the position in which the nozzle is inserted in the container, and then to achieve the full rinsing of the container that is to be rinsed.

In order to enable the nozzle to be withdrawn to its withdrawn position, the nozzle is, in many embodiments, pretensioned in the withdrawn position by means of a pretensioning device, for example by means of a helical spring or by means of an elastomer. Accordingly, when the appropriate pressure conditions are present it is possible to achieve the automatic withdrawal of the nozzle, in particular when the rinsing medium no longer exerts a pressure on a nozzle piston, or when there is an appropriate counterpressure on the side of the medium outlet.

A further improvement of the hygienic properties of the device can be achieved by the pretensioning in the withdrawn position being effected by magnets, which operate without wear. Accordingly, the possible introduction of particles can be still further reduced, since abrasion of an elastomer or a return spring is avoided, and rupture of the spring or disintegration of the elastomer cannot occur, so that here too undesired introduction of particles can be averted.

BRIEF DESCRIPTION OF THE FIGURES

Further embodiments of the present invention are more fully explained by the description below of the figures.

DETAILED DESCRIPTION

Examples of embodiments are described below with the aid of the figures. In the figures, elements which are identical or similar, or have identical effects, are designated with identical reference signs. In order to avoid redundancy, repeated description of these elements is in part dispensed with in the description below.

Figure 1:
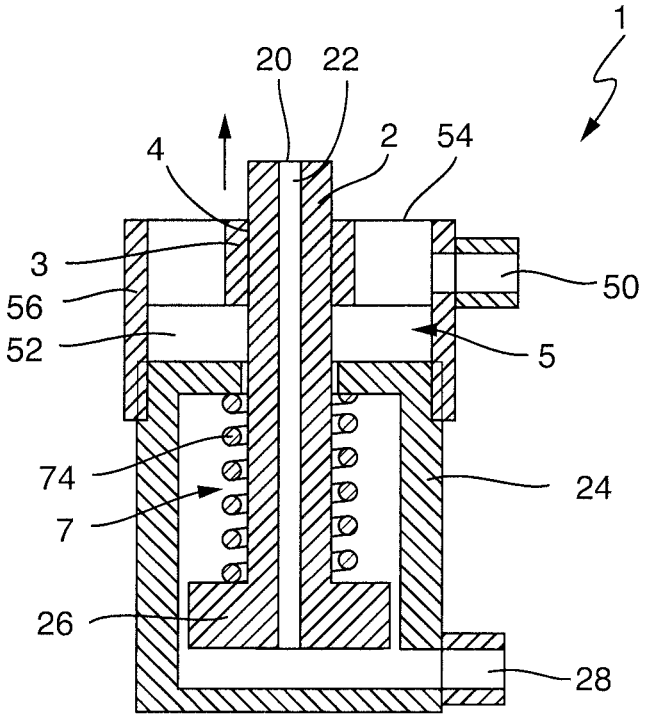
FIG. 1 shows a schematic sectional representation of a device for rinsing a container in a first embodiment.

FIG. 1 shows a schematic cross-sectional representation of a device 1 for rinsing a container (which is not shown here) with a rinsing medium. A nozzle 2 with a medium outlet 20 is provided, with the rinsing medium being introduced into the container that is to be rinsed through the medium outlet 20.

The nozzle 2 can be advanced in the direction indicated by the arrow, and in this manner inserted into the container that is to be rinsed, in order thereby to reach a position in which it is inserted in the container. The rinsing medium thereby passes through a medium channel 22 in the nozzle 2, in order that it can exit from the medium outlet 20.

In FIG. 1, the nozzle 2 is shown in its withdrawn position, in which for example the container that is to be rinsed can be positioned or replaced above the nozzle.

The nozzle 2 is guided in a guide 3, wherein the nozzle 2 is displaceable relative to the guide 3, in particular between the withdrawn position that is shown in FIG. 1 and a position in which the nozzle 2 has been advanced relative to the guide 3 in the direction indicated by the arrow, which corresponds to the position in which it is inserted in the container.

Between the guide 3 and the nozzle 2 a guide surface 4 is formed, along which the guide 3 guides the nozzle 2. The guide surface 4 is designed here as a slide bearing, so that the outside of the nozzle 2 thus slides along the inside of the guide 3. During the process of sliding the nozzle 2 relative to the guide 3 between the withdrawn position shown in FIG. 1 and a position in which it is inserted in the container, it can occur that particles are detached on or due to the guide 3. These particles can either be deposited by the actual rinsing process on the outer surface of the nozzle 2 or the inner surface of the guide 3, or wear can result from the movement of the nozzle 2 in the guide 3, which leads to material breaking away from the guide 3 or the surface of the nozzle 2. In each of these cases, particles are set free when the nozzle 2 moves relative to the guide 3. It is to be feared that these particles could then be introduced via the rinsing medium into the container, or reach the surrounding area and in this manner contaminate the surrounding area.

In order to prevent such introduction of particles into the container that is to be rinsed, a suction extractor 5 is provided, which is connected by means of an extraction connecting piece 50 to an underpressure device or suction extraction device (neither of which is shown). In the example embodiment shown in FIG. 1, the suction extractor 5 is provided such that it enables extraction by suction at least partially below the guide 3, i.e. the guide surface 4. For this purpose a suction chamber 52 is provided, which is in fluid communication with the extraction connecting piece 50, and from which extraction by suction thus takes place via the extraction connecting piece 50. In the example embodiment that is shown, the suction chamber 52 of the suction extractor 5 is disposed below the guide 3. The guide 3 is thus disposed between the medium outlet 20 of the nozzle 2 and the suction extractor 5, and in particular between the medium outlet 20 of the nozzle 2 and the suction chamber 52 of the suction extractor 5.

Because the guide 3, and in particular the guide surface 4, is disposed between the medium outlet 20 and the suction extractor 5, a volume flow is directed towards the suction extractor 5, i.e. towards the extraction connecting piece 50, which conveys away any particles that are detached or set free from the guide 3 or the nozzle 2. These particles, which are in particular detached at the guide surface 4, are then sucked away, and cannot be introduced into the interior of the container that is to be treated or rinsed. In this case, these particles also do not contaminate the surroundings, with the result that not only the hygiene of the rinsing device itself but also the hygiene of the beverage filling plant as a whole can be improved.

Figure 4:
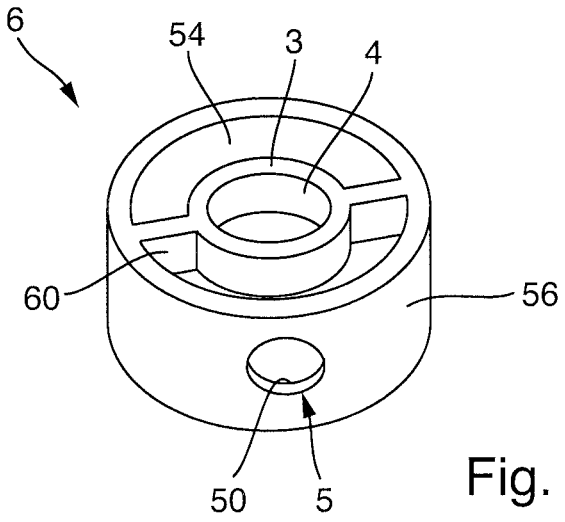
FIG. 4 shows a schematic perspective representation of a guide in combination with a suction extractor.

In the example embodiment that is shown, the suction extractor 5 comprising the suction chamber 52 and the extraction connecting piece 50 is integrated with the guide 3. An appropriate mouth attachment 6 can be seen in FIG. 4, which shows both the guide 3 with the guide surface 4 and the attachment for the extraction connecting piece 50. This is accordingly a mouth attachment 6 which makes it possible to provide both a guide 3 for the nozzle 2 and a suction extractor 5 for at least a portion of the rinsing medium that flows back out of the container, and for particles that are set free. The mouth attachment 6 is attached to the nozzle body 24 (see FIG. 1), and additionally provides a suction aperture 54.

In the mouth attachment 6, the guide 3 is fixedly attached by at least one crosspiece 60 to an outer wall 56 that defines the suction chamber 52. The mouth attachment 6 can be formed as a single piece, for example as an injection molded part or casting.

In FIG. 1, the nozzle body 24 is provided in order to accommodate a nozzle piston 26 of the nozzle 2 such that the nozzle piston 26 forms a substantially gas-tight seal with a drilled aperture in the nozzle body 24. Via a rinsing medium intake 28, it is possible to convey rinsing medium into the nozzle piston 24 such that it both applies pressure to the nozzle piston 26 and passes through the medium channel 22 to the medium outlet 20. By means of appropriate dimensioning of the nozzle piston 26 and the medium channel 22, a pressure is exerted on the nozzle 2 such that it is pushed in the direction indicated by the arrow out from the nozzle body 24, and can thereby be brought to the position in which it is inserted in the container.

A pretensioning device 7, shown here in the form of a helical spring 74, is also provided, and applies a force to the rear of the nozzle piston 26 that counteracts the pressure that displaces it.

Accordingly, the nozzle 2 can be displaced from the withdrawn position, into which it is pressed by means of the pretensioning device 7, to the position in which it is inserted in the container, in that an appropriate rinsing medium pressure is applied to the nozzle piston 26 via the rinsing medium intake 28, such that the rinsing medium pressure is exerted on the nozzle piston 26. The force thereby arising compresses the pretensioning device 7, so that the nozzle 2 is pushed in the direction of the interior of the container.

Ambient air or ambient atmosphere, along with the rinsing medium that flows back out of rinsed container, flows into the suction extractor 5 via the suction aperture 54, which is oriented in the direction of the medium outlet 20. If the rinsing is carried out with a gas, for example air, sterile air or ionized air, when the container has been rinsed the air accordingly flows back out of its mouth and enters the suction extractor via the suction aperture 54. Together with the rinsing medium, particles that are flushed out of the rinsed container are also sucked out via the suction extractor 5. At the same time, due to the flow of rinsing medium directed to the suction extractor 5 and the suction extractor itself, the extraction by suction takes place of particles that may have detached from the guide surface 4, the guide 3 and/or the exterior of the nozzle 2. Thus, an improved removal takes place of the particles that are flushed out of the rinsed container, as well as the particles that are produced within the device for rinsing. Furthermore, these particles are not released into the surroundings, but are, at least in part, extracted via the suction extractor 5.

Figure 2:
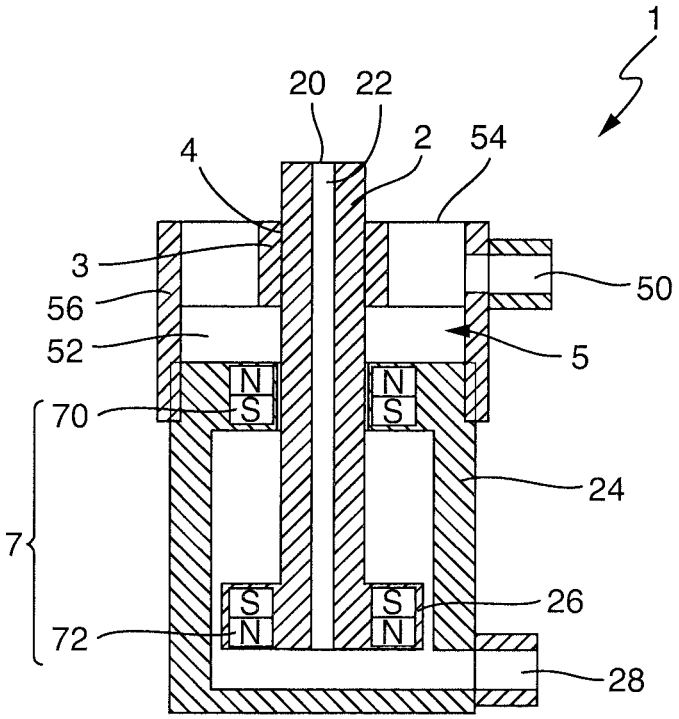
FIG. 2 shows a schematic sectional representation of a device for rinsing a container in a second embodiment.

FIG. 2 shows a device 1 for rinsing a container with a rinsing medium in a further example embodiment. The design is similar to that shown in FIG. 1. The only difference is that the pretensioning device 7, which was embodied in FIG. 1 by a helical spring, is here provided by two magnets 70, 72, whose poles are oriented such that they repel each other. One of the magnets 70 is disposed on the nozzle body 24, and the other magnet 72 is provided on the nozzle piston 26. By means of the pre-tension of the nozzle 2 in the withdrawn position that is provided in this manner by the magnets 70, 72, a low-wear and thereby hygienically further improved device 1 can be provided. No friction or wear normally occurs at the magnets 70, 72, with the result that at this point there can be no detaching of particles, which could enter the interior of the container or the surroundings.

Figure 3:
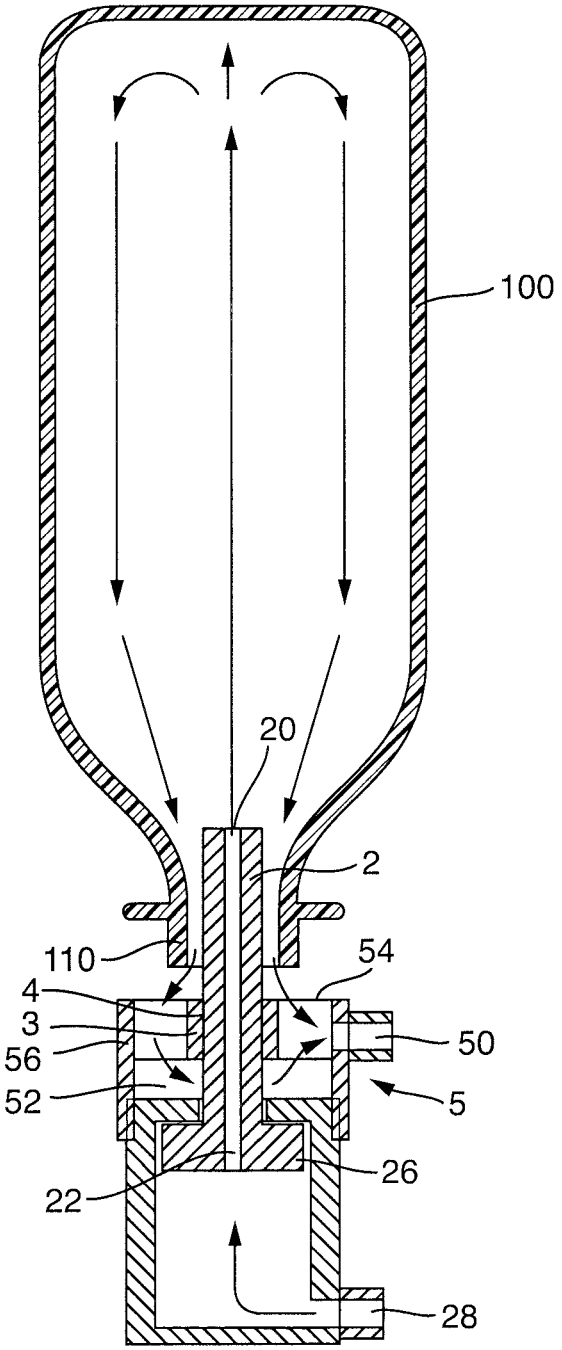
FIG. 3 shows a schematic sectional representation of the process of rinsing a container.

FIG. 3 shows a schematic representation of the actual process of rinsing a container 100, wherein the arrows indicate the flow of rinsing medium that is introduced into the interior of the container 100 by means of the rinsing medium discharged from the nozzle 2, i.e. its medium outlet 20, which is now in the position in which it is inserted in the container.

The mouth 110 of the container that is to be rinsed is disposed over the nozzle 2, i.e. the nozzle 2 is inserted in the mouth 110 of the container 100. The dimensions of the nozzle 2 are such that an annular gap, through which the rinsing medium can leave the container 100, remains between the nozzle 2 and the mouth 110 of the container 100.

It can be seen by means of the schematically shown arrows that the rinsing medium that flows out of the container 100 passes into the suction extractor 5 via the suction aperture 54 that is disposed on its face, in order then to be sucked via the suction chamber 52 into the extraction connecting piece 50. In the process the rinsing medium also flows around the guide 3, the guide surface 4 and/or the nozzle 2, so that the guide 3 is surrounded by the suction extractor, and accordingly particles that are detached in the area of the guide 3 in the region of the guide surface 4 or on the outside of the nozzle 2, can be extracted via the suction extractor 5.

To the extent applicable, all individual features described in the individual example embodiments can be combined with each other and/or exchanged, without departing from the field of the invention.

The invention claimed is:

1. A device for rinsing a container with a rinsing medium comprising:

a nozzle configured to introduce the rinsing medium into the container, wherein the nozzle comprises an outlet through which the rinsing medium enters the container that is to be rinsed, and is configured to be displaceable between a withdrawn position for positioning the container and a position in which the nozzle is inserted in the container for rinsing the container with the rinsing medium;

a suction extractor configured to extract by suction at least a portion of the rinsing medium that flows back out of the container; and a guide disposed between the outlet and at least a region of the suction extractor, wherein:

the nozzle is displaceably guided in the guide, and the guide encircles and contacts a portion of the nozzle in the position in which the nozzle is inserted in the container.

2. The device of claim 1, wherein the guide comprises a guide surface and the guide surface comprises a slide bearing that is formed between the guide and the nozzle.

3. The device of claim 2, wherein the suction extractor is configured to enable extraction by suction at least partially below the guide surface.

4. The device of claim 1, wherein the suction extractor comprises a suction chamber and an extraction connecting piece, and the guide is further disposed between the outlet and the suction chamber.

5. The device of claim 1, wherein the suction extractor surrounds the guide.

6. The device of claim 1, wherein the guide is entirely disposed in an area in which extraction by suction is carried out by the suction extractor.

7. The device of claim 1, wherein the suction extractor comprises a suction aperture configured to extract rinsing medium that flows back out of the container by suction.

8. The device of claim 7, wherein the suction aperture is oriented in a direction of the outlet.

9. The device of claim 1, wherein the nozzle further comprises a nozzle piston configured to displace the nozzle by an application of a rinsing medium pressure from the withdrawn position to the position in which the nozzle is inserted in the container.

10. The device of claim 1, wherein the nozzle is pretensioned in the withdrawn position using a pretensioning device.

11. The device of claim 10, wherein the pretensioning device comprises a helical spring, an elastomer and/or a pair of magnets.

12. The device of claim 11, wherein the pair of magnets are oriented such that the pair of magnets repel each other.

13. The device of claim 12, wherein a first one of the pair of magnets is disposed on a body of the nozzle and a second one of the pair of magnets is disposed on a nozzle piston.

14. A device for rinsing a container with a rinsing medium comprising:

a nozzle configured to introduce the rinsing medium into the container, wherein the nozzle comprises an outlet through which the rinsing medium enters the container that is to be rinsed, and is configured to be displaceable between a withdrawn position for positioning the container and a position in which the nozzle is inserted in the container for rinsing the container with the rinsing medium, and wherein the nozzle further comprises a nozzle piston configured to displace the nozzle by an application of a rinsing medium pressure from the withdrawn position to the position in which the nozzle is inserted in the container;

a suction extractor configured to extract by suction at least a portion of the rinsing medium that flows back out of the container; and a guide disposed between the outlet and at least a region of the suction extractor, wherein the nozzle is displaceably guided in the guide and the suction extractor is integrated with the guide.

15. The device of claim 14, wherein the suction extractor surrounds the guide.

16. The device of claim 14, wherein the suction extractor comprises a suction aperture configured to extract rinsing medium that flows back out of the container by suction.

17. The device of claim 14, wherein the nozzle is pretensioned in the withdrawn position using a pretensioning device.

18. The device of claim 17, wherein the pretensioning device comprises a helical spring, an elastomer and/or a pair of magnets.

19. A device for rinsing a container with a rinsing medium comprising:

a nozzle body comprising a nozzle configured to introduce the rinsing medium into the container, wherein the nozzle comprises an outlet through which the rinsing medium enters the container that is to be rinsed, and is configured to be displaceable between a withdrawn position for positioning the container and a position in which the nozzle is inserted in the container for rinsing the container with the rinsing medium; and a mouth attachment attached to the nozzle body comprising:

an outer wall surrounding:

a suction aperture configured to extract rinsing medium that flows back out of the container by suction, and a guide comprising a guide surface that encircles and contacts a portion of the nozzle in the position in which the nozzle is inserted in the container, wherein:

the outer wall defines a suction chamber, and the suction chamber is disposed below the guide.

20. The device of claim 19, wherein:

the suction aperture is disposed between the guide and the outer wall along a transverse axis of the mouth attachment, and the mouth attachment further comprises a crosspiece configured to attach the guide to the outer wall.

* * * * *